US012534117B2

(12) United States Patent
Schuchmann et al.

(10) Patent No.: US 12,534,117 B2
(45) Date of Patent: Jan. 27, 2026

(54) METHOD FOR DETERMINING A CHANGE OF A STATE OF A TRACK SECTION OF A RAILROAD AND CORRESPONDING APPARATUS

(71) Applicant: KB Signaling Inc., West Henrietta, NY (US)

(72) Inventors: Christopher J. Schuchmann, Rockledge, FL (US); Jeffrey Fries, Grain Valley, MO (US); John Ross, West Melbourne, FL (US); Anuka Sawh, Melbourne, FL (US); Shilpa Cherian, Melbourne, FL (US)

( * ) Notice: Subject to any disclaimer, the term of this patent is extended or adjusted under 35 U.S.C. 154(b) by 508 days.

(21) Appl. No.: 18/317,693

(22) Filed: May 15, 2023

(65) Prior Publication Data

US 2024/0383511 A1 Nov. 21, 2024

(51) Int. Cl.
*B61L 23/04* (2006.01)

(52) U.S. Cl.
CPC ..... *B61L 23/044* (2013.01)

(58) Field of Classification Search
CPC ..... B61L 1/182; B61L 23/04; B61L 23/044
See application file for complete search history.

(56) References Cited

U.S. PATENT DOCUMENTS 2,051,742 A * 8/1936 Poynter ..... B61L 11/00 246/219
4,117,529 A * 9/1978 Stark ..... B61L 23/044 361/182
10,081,379 B2 * 9/2018 Kull ..... B61L 27/53
2007/0132463 A1 * 6/2007 Anderson ..... B61L 1/181 324/713
2008/0296441 A1 * 12/2008 Anderson ..... B61L 23/044 246/121
2022/0355841 A1 * 11/2022 Fries ..... G01V 3/02
2024/0383511 A1 * 11/2024 Schuchmann ..... B61L 23/044

FOREIGN PATENT DOCUMENTS

CN 111038525 A * 4/2020 ..... B60L 9/00
CN 211893188 U * 11/2020
GB 2548141 A * 9/2017 ..... B61L 1/20
GB 2608681 A * 1/2023 ..... B61L 23/163
WO WO-2016074912 A1 * 5/2016 ..... B61L 27/04
WO WO-2024241075 A1 * 11/2024 ..... B61L 23/042
WO WO-2025181506 A1 * 9/2025 ..... B61L 1/20

* cited by examiner

*Primary Examiner* — Jason C Smith
(74) *Attorney, Agent, or Firm* — David L. Nocilly; Bond Schoeneck & King PLLC

(57) ABSTRACT

A method determines a change of a state of a track section of a railroad. The track section includes a first end electrically connected to a first track device, a second end electrically connected to a second track device, and rails connecting the first end with the second end. The track section is associated with at least one computing unit. At least one of the first and second track devices is in communication with the computing unit. Upon initialization of the method, the state of the track section is a first predetermined state. At least one of the first track device and the second track device is a receiving track device, which measures a received current intensity at a receiving end. The method includes a first monitoring of the received current intensity and a second monitoring of a transmitted current intensity.

10 Claims, 2 Drawing Sheets

METHOD FOR DETERMINING A CHANGE OF A STATE OF A TRACK SECTION OF A RAILROAD AND CORRESPONDING APPARATUS

FIELD

The present invention relates to a method for determining a change of a state of a track section of a railroad.

The present invention further relates to an apparatus for determining a change of a state of a track section of a railroad.

The present invention also relates to a non-transitory computer readable medium including a computer program comprising software instructions which, when executed by a computer, implement a method for determining a change of a state of a track section of a railroad.

BACKGROUND

For signaling purposes, a railroad is subdivided in a plurality of successive track sections.

In order to implement safe train control of trains circulating on the railroad, an occupancy status of each track section has to be known. For example, the occupancy status of a track section may be "occupied" or "unoccupied".

Track circuits implemented along the railroad are adapted to determine the corresponding occupancy status. In particular, such track circuits use a transmitter to inject a current into the rails at one end of the corresponding track section, and a receiver to capture the resulting current at the other end of the track section. In function of the captured current at the receiver, the occupancy status of the track section is determined.

In order to distinguish in particular, the occupancy status between "occupied" and "unoccupied", a fixed threshold is defined to separate between these occupancy statuses. The fixed threshold is not always adapted for the corresponding track section. In addition, a resistance, for example a ballast resistance between the rails, may change for example depending on weather conditions. Furthermore, a change of the received current at the receiver may depend on material characteristics of the rails and/or the railway vehicle circulating in the track section.

Therefore, it is difficult for such track circuits to determine in a safe and reliable manner the occupancy status of the track section with a fixed threshold, given numerous different variables having an impact on the resulting current captured by the receiver.

Another example is a case in which a rail of the track section is broken, which also has an impact on the received current and has to be taken into account by the receiver.

Additionally, for example, this invention allows for unique identification of a track circuit occupied by a train versus occupied due to a broken rail. This unique identification also allows for extended lengths of monitored track sections in particular without additional equipment, thereby reducing overall cost of implementation through less monitoring infrastructure.

SUMMARY

An objective of the present invention is to obtain a method allowing determining a change of the state of a track section in a safe and flexible manner.

In particular, an objective of the present invention is to obtain a method for determining such change of the state, which is adaptable flexibly to different operating conditions, and guarantees safe and reliable operation. Another objective is to obtain a method which requires less equipment at the railroad and is in particular more cost effective.

For this purpose, the subject matter of the invention relates to a method for determining a change of a state of a track section of a railroad, the track section comprising a first end electrically connected to a first track device, and a second end electrically connected to a second track device, the track section further comprising rails connecting the first end with the second end, the track section being associated with at least one computing unit, at least one of the first track device and the second track device being in communication with the computing unit, upon initialization of the method, the state of the track section being a first predetermined state, wherein at least one of the first track device and the second track device, called receiving track device, measures a received current intensity at a receiving end, the receiving end being the end among the first end and the second end, which is electrically connected to the receiving track device, wherein the received current intensity is equal to a first initial value upon initialization of the method, and the first track device applies a voltage to the first end and measures a transmitted current intensity transmitted by the first track device along the rails of the track section towards the second end, wherein the transmitted current intensity is equal to a second initial value upon initialization of the method, the method comprising:

first monitoring of the received current intensity, wherein the first monitoring comprises comparing at least one present value of the received current intensity measured by the receiving track device with said first initial value so as to obtain a relative change value comprising a percentage of variation of the received current intensity, wherein the first monitoring further comprises comparing the relative change value with a relative threshold value so as to obtain a comparison result;

second monitoring comprising monitoring of the transmitted current intensity so as to obtain a monitoring result, the second monitoring being implemented if the comparison result indicates a decrease of the received current intensity according to the relative change value more than the relative threshold value;

changing of the state of the track section, in function of the monitoring result, to a second predetermined state or a third predetermined state.

According to other advantageous aspects of the invention, the method comprises one or more of the following features, taken separately or in any technical feasible combination:

the changing of the state of the track section comprises changing the state to the second predetermined state if the monitoring result indicates an increase of the transmitted current intensity in comparison with the second initial value, said changing comprises changing the state to the third predetermined state if the monitoring result indicates a decrease of the transmitted current intensity in comparison with the second initial value;

the second monitoring comprises monitoring the transmitted current intensity during a predetermined time period delimited by a start time and an end time, so as to obtain the monitoring result, wherein, if during said predetermined time period, a present value of the transmitted current intensity is higher than the second initial value, the second monitoring further comprises modifying a flag value from an inactive flag value to an active flag value, wherein said changing comprises changing of the state in function of the flag value;

said changing of the state is implemented at the earliest at said end time.

said changing comprises changing the state of the track section to the second predetermined state, if the flag value is the active flag value at the end time, and wherein said changing comprises changing the state of the track section to the third predetermined state, if the flag value is the inactive flag value at the end time;

the first predetermined state corresponds to the track section being unoccupied, the second predetermined state corresponds to the track section being occupied by a railway vehicle, and the third predetermined state corresponds to at least one of the rails of the track section being broken;

at least one of the first monitoring and the second monitoring is implemented in form of a monitoring loop, wherein the monitoring loop of the first monitoring comprises comparing a plurality of consecutive present values of the received current intensity with said first initial value, and/or wherein the monitoring loop of the second monitoring comprises monitoring of a plurality of consecutive present values of the transmitted current intensity with the second initial value;

the relative threshold value is substantially equal to 45%.

The subject matter of the invention is also an apparatus for determining a change of a state of a track section of a railroad comprising a first end, a second end and rails connecting the first and with the second end, the apparatus comprising a first track device configured to be electrically connected to the first end of the track section, a second track device configured to be electrically connected to the second end of the track section, and at least one computing unit configured to communicate with at least one of the first track device and the second track device, wherein the apparatus is configured to present an initial condition, in which the state of the track section is defined to a first predetermined state, wherein at least one of the first track device and the second track device, called receiving track device, measures a received current intensity received at a receiving end, the receiving end being the end among the first end, which is electrically connected to the receiving track device, wherein, in the initial condition, the received current intensity is equal to a first initial value, wherein the first track device applies a voltage to the first end and measures a transmitted current intensity transmitted by the first track device along the rails of the track section towards the second end, and wherein, in the initial condition, the transmitted current intensity is equal to a second initial value, wherein the computing unit is configured for implementing:

first monitoring of the received current intensity, wherein the first monitoring comprises comparing at least one present value of the received current intensity measured by the receiving track device with said first initial value so as to obtain a relative change value comprising a percentage of variation of the received current intensity, wherein the first monitoring further comprises comparing the relative change value with a relative threshold value so as to obtain a comparison result;

second monitoring comprising monitoring of the transmitted current intensity so as to obtain a monitoring result, the second monitoring being implemented if the comparison result indicates a decrease of the received current intensity according to the relative change value more than the relative threshold value;

changing of the state of the track section, in function of the monitoring result, to a second predetermined state or a third predetermined state.

The subject matter of the invention comprises also a non-transitory computer readable medium including a computer program comprising software instructions which, when executed by a computer, implement a method as described above.

BRIEF DESCRIPTION OF THE DRAWINGS

The features of the invention will become more clear upon reading the description which follows, given solely by way of a non-limiting example, and with reference to the appended drawings, wherein.

DETAILED DESCRIPTION

Figure 1:
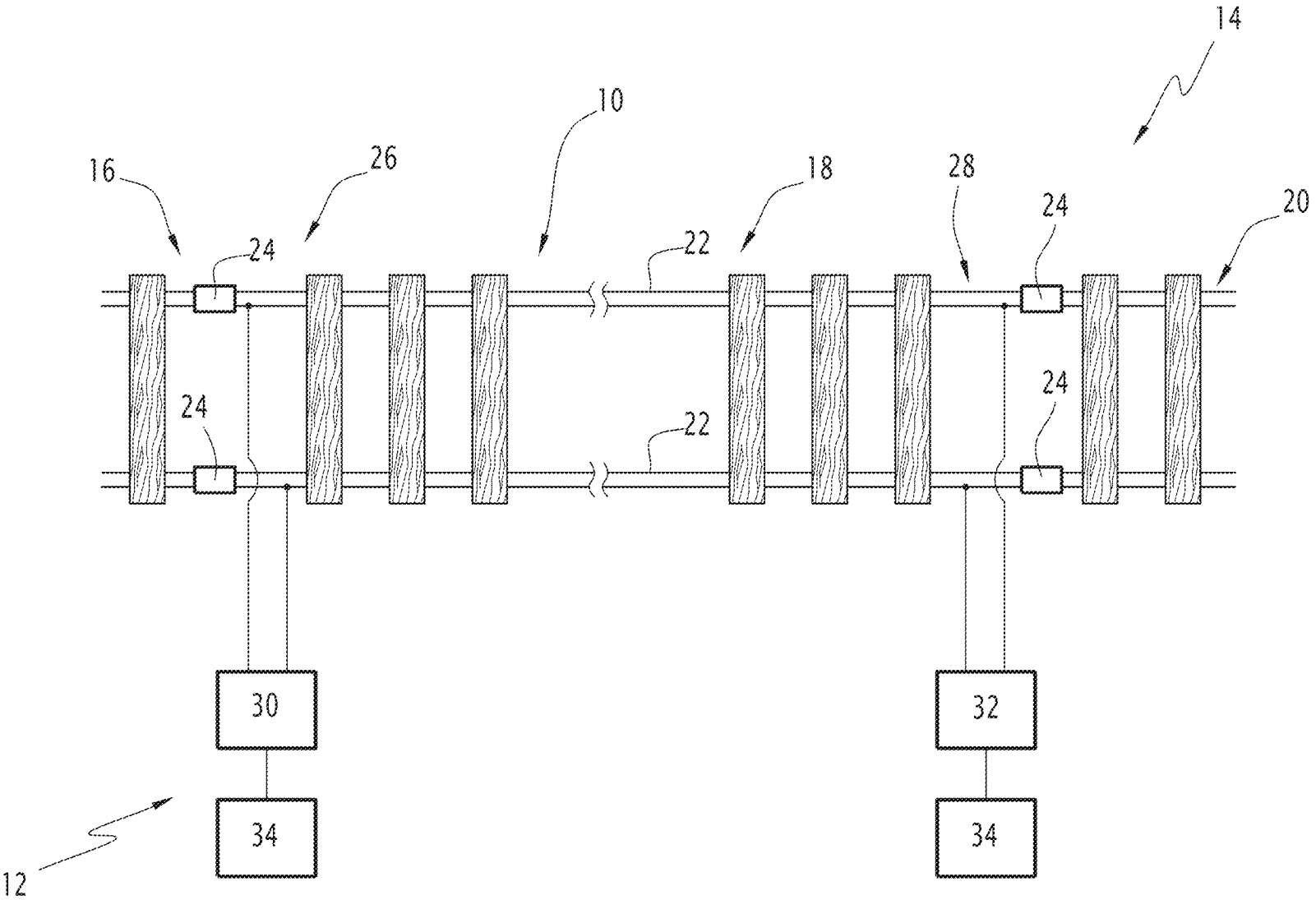
FIG. 1 is a schematic representation of an infrastructure comprising a railroad and an apparatus configured for implementing a method for determining a change according to the invention.

With reference to FIG. 1, an infrastructure 10 comprises an apparatus 12 and a railroad 14.

The railroad 14 is subdivided into successive track sections 16, 18, and 20.

Each track section 16, 18, 20 is made of a pair of rails 22. Furthermore, the railroad 14 comprises a plurality of joints 24 arranged in the rails 22 between the track section 16, 18, 20. The joints 24 are configured for insulating electrically the rails 22 from one track section 16, 18, 20 to another.

Each track section 16, 18, 20 comprises a first end and a second end opposite to the first end. For example, the track section 18 comprises the first end 26 and the second end 28. Each end 26, 28 is in particular defined by the corresponding joints 24.

As illustrated in the FIG. 1, the rail 22 connects the first end 26 with the second end 28 between the joints 24.

The apparatus 12 comprises a first track device 30, a second track device 32, and at least one computing unit 34.

The first track device 30 is electrically connected to the first end 26, in particular to the rails 22 at the first end 26, and the second track device 32 is electrically connected to the second end 28, in particular to the rails 22 at the second end 28.

The first track device 30 is configured for applying a first voltage to the first end 26 so that a current is transmitted in the rails 22 towards the second track device 32.

The voltage applied by the first track device 30 is for example a predetermined voltage. Preferably, the first voltage has a constant maximum value.

The first track device 30 is further configured for measuring a transmitted current intensity transmitted by itself along the rails 22, in particular resulting from the application of the first voltage. According to an example, the first track device 30 is further configured for measuring a received current.

At least one of the first track device 30 and the second track device 32 is defined as a receiving track device. The receiving track device is configured for measuring a received current intensity at a receiving end to which said receiving track device is connected.

For example, the receiving track device is the first track device 30. In this case, the receiving end is the first end 26 and the first track device 30 is configured for measuring the received current intensity received at the first end 26 resulting from an application of a second voltage at the second end 28 by the second track device 32.

The second voltage is for example a predetermined voltage. Preferably, the second voltage has a constant maximum value.

The or each computing unit 34 is configured for communicating with at least one of the first track device 30 and the second track device 32, in particular via corresponding data connection(s).

In the example of FIG. 1, the apparatus 12 comprises two computing units 34. For example, each computing unit 34 is configured for communicating with one of the first and second track device 30, 32. Preferably, each computing unit 34 is identical. According to other embodiments, the apparatus 12 comprises a single computing unit 34, configured for communicating with one of the first and second track device 30, 32, or with both devices 30, 32.

The or each computing unit 34 comprises for example at least one processor, and at least one memory, not shown. The processor is in particular configured for executing software instructions memorized on the memory, so as to implement at least some steps of a method for determining a change of a state of the track section 18.

The or each computing unit 34 is configured for implementing a first monitoring of the received current intensity, a second monitoring of the transmitted current intensity, and a changing of the state of the track section 18.

Figure 2:
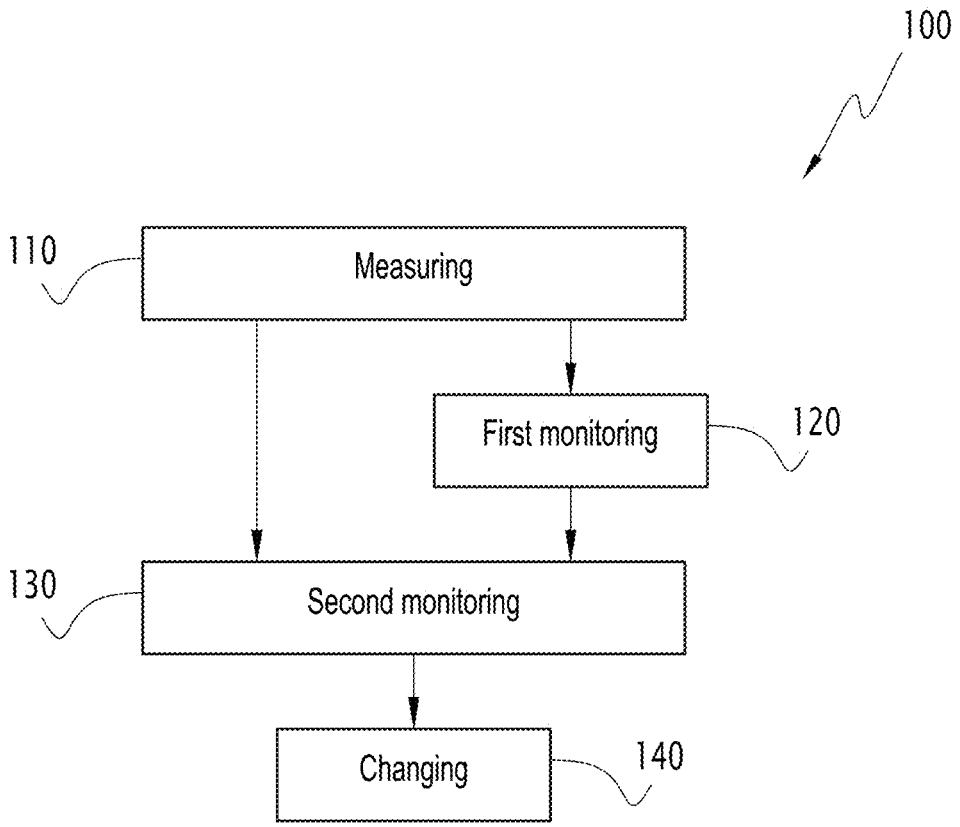
FIG. 2 is a flow diagram of the method for determining a change of the invention implemented by the infrastructure of FIG. 1.

A method 100 for determining a change of a state of the track section 18 will now be described with reference to FIG. 2 comprising a flow diagram of the method 100.

According to an example of the method 100 described hereafter, the receiving track device is the first track device 30. In this case, the first track device 30 measures both the transmitted current intensity and the received current intensity, at the first end 26. The method 100 comprises a measuring step 110, a first monitoring phase 120, a second monitoring phase 130 and changing step 140.

Upon initialization of the method, the apparatus 12 is in an initial condition.

Furthermore, upon initialization of the method 100, the track section 18 is in a first predetermined state.

The first predetermined state of the track section 18 corresponds for example to the track section 18 being unoccupied. By the expression "unoccupied", it is understood that no railway vehicle is present in the corresponding track section.

Still upon initialization of the method 100, the first track device 30 measures the received current intensity received at the first end 26, received from the second track device 32, in particular resulting from the application of the second voltage by the second track device 32 to the rails 22 at the second end 28. Upon initialization of the method 100, the received current intensity is equal to a first initial value.

The first track device 30 applies the first voltage to the first end 26 and measures the transmitted current intensity transmitted by the first track device 30 itself along the rails 22 of the track section 18 resulting in particular from the application of the first voltage. Upon initialization of the method 100, the transmitted current intensity, which is measured by the first track device 30, is equal to a second initial value.

During the measuring step 110, the first track device 30 measures a present value of the received current intensity.

By "present value", it is understood an instantaneously measured value, or the value obtained at the moment of the execution of the measurement.

Furthermore, for example, during the measuring step 110, the first track device 30 measures a present value of the transmitting current intensity.

Preferably, the present value of the received current intensity, used during the first monitoring phase 120, and the present value of the transmitting current intensity, used during the second monitoring phase 130, are obtained simultaneously. This is in particular illustrated by arrows from the measuring step 110 to phases 120 and 130 in FIG. 2.

The present value of the transmitted current intensity, the present value of the received current intensity, the first initial value and/or the second initial value is/are for example values of the corresponding current intensity in ampere.

During the first monitoring phase 120, the computing unit 34 in communication with the first track device 30 monitors the received current intensity.

In particular, during the first monitoring phase 120, the computing unit 34 receives the present value of the received current intensity.

The first monitoring phase 120 comprises comparing at least one present value, in particular the present value of the received current intensity, received from the first track device 30, with the first initial value. By this comparison, the computing unit 34 obtains a relative change value comprising a percentage of a variation of the received current intensity.

By "relative change value", it is understood a percentage value.

In particular, the relative change value defines a decrease, in percentage, of the received current intensity compared with the first initial value.

For example, the relative change value is calculated as follows:

$$R = \frac{i - p}{i} * 100\%$$

with:

R being the relative change value;

p being the received current intensity according to the present value, for example in ampere, and i being the first initial value, for example in ampere.

In particular, the higher the percentage value of the relative change value, the stronger is the decrease of the received current intensity compared with the first initial value.

For example, if the present value of the received current intensity, for example in ampere, is half on the first initial value, also for example in ampere, the relative change value is equal to 50%.

The first monitoring phase 120 furthermore comprises comparing of the relative change value with a relative threshold value, so as to obtain a comparison result.

By "relative threshold value", it is understood a percentage value forming a percentage threshold. The relative threshold value is for example a predetermined percentage value. For example, the relative threshold value is substantially equal to 45%.

The comparison result is for example a binary value, being equal to "1" if the relative change value is a percentage value higher than or equal to the relative threshold value, and being equal to "0" otherwise.

The second monitoring phase 130 is implemented if the comparison result indicates a decrease of the received current intensity according to the relative change value more than the relative threshold value. In particular, in the above-given example, the second monitoring phase 130 is implemented if the comparison result is equal to "1". In other words, the second monitoring phase 130 is implemented, if the percentage value of the relative change value is equal to or higher than the relative threshold value.

For example, with a given relative threshold value equal to 45%, the second monitoring phase 130 is implemented, if the relative change value is equal to or higher than 45%, being consistent with a decrease of the received current intensity of 45% or more.

In particular, the computing unit 34 in communication at least with the first track device 30 implements a surveillance of the comparison result, and triggers the second monitoring phase 130 if the comparison result indicates a decrease of the received current intensity according to the relative change value more than the relative threshold value.

As an example, if the received current intensity according to the present value only decreases slightly, the relative change value is lower than the relative threshold value and the comparison result remains equal to "0". In this case, the method 100 comprises for example a repetition of the measuring step 110 and the first monitoring phase 120, prior to an implementation of the second monitoring phase 130.

The second monitoring phase 130 comprises monitoring of the transmitted current intensity so as to obtain a monitoring result.

The monitoring result comprises in particular an information regarding the evolution of the transmitted current intensity as measured by the first track device 30. For example, the monitoring result indicates an increase or a decrease of the transmitted current intensity as measured by the first track device 30, compared with the second initial value of this transmitted current intensity.

Since an increase or decrease can represent only a small change, a relative change threshold is preferably implemented for the change in transmitted current intensity. For example, a decrease in transmitted current intensity is considered one in which the present value has decreased by at least 1.5% compared to the second initial value, otherwise the change is considered an increase.

The changing step 140 comprises changing the state of the track section, in particular of the track section 18, in function of the monitoring result, either to a second predetermined state, or to a third predetermined state.

The second and third predetermined states are in particular different from the first predetermined state.

For example, the second predetermined state corresponds to the track section 18 being occupied by a railway vehicle.

For example, the third predetermined state corresponds to at least one of the rails 22 of the track section 18 being broken.

By the expression "broken", it is understood here in particular that at least one of the rails 22 comprises a mechanical defect decreasing or even interrupting a transmission of current between the first and second ends 26, 28. For example, the expression "broken" comprises a partial or complete fracture of at least one of the rails 22.

For example, the changing step 140 comprises changing the state of the track section 18 to the second predetermined state, if the monitoring result indicates an increase of the transmitted current intensity in comparison with the second initial value. In particular, an increase of the transmitted current indicates that axles of a railway vehicle present in the track section 18 shunt the two rails 22, so that the transmitted current intensity injected by the first track device 30 increases, whereas the received current intensity as received by the first track device 30 decreases. Indeed, the current transmitted by the second track device 32, is shunted by the axle(s) of the railway vehicle before arriving at the first end 26 and thus before being measured by the first track device 30.

According to an example, the changing step 140 comprises changing the state of the track section 18 to the third predetermined state, if the monitoring result indicates a decrease of the transmitted current intensity in comparison with the second initial value. Indeed, this scenario corresponds to at least one rail 22 the track section 18 being broken. In this case, a decrease of the received current intensity coincides with a decrease of the transmitted current intensity, for example.

In particular, the computing unit 34 in communication at least with the first track device 30 changes the state to the third predetermined state if the comparison result indicates a decrease of the received current intensity according to the relative change value more than the relative threshold value and, at the same time, the monitoring result indicates a decrease of the transmitted current intensity.

The changing of the state during the changing step 140 is in particular implemented by the computing unit 34 in communication at least with the first track device 30, modifying the state of the track section for example in a corresponding database and/or sending a corresponding signal to a control center.

Referring again to the second monitoring phase 130, according to embodiments, this phase comprises monitoring the transmitted current intensity during a predetermined time period, which is in particular delimited by a start time and an end time, so as to obtain the monitoring result.

The predetermined time period is for example of a duration comprised between 3 minutes and 5 minutes.

If, during the predetermined time period, a present value or a plurality of present values of the transmitted current intensity is/are higher than the second initial value, the second monitoring phase 130 further comprises modifying a flag value from an inactive flag value to an active flag value. In this case, the present value(s) of the transmitted current intensity correspond(s) in particular to a currently measured value of the transmitted current intensity, as measured by the first track device 30.

The flag value is for example a binary value having either the value "0", if the flag value is in the inactive flag value, or having the value "1", if the flag value is in the active flag value.

For example, during the second monitoring phase 130, the transmitted current intensity is monitored over time to detect if the intensity increases at least once during the predetermined time period, and thus to modify the flag value in consequence. Such increase would be consistent with a railway vehicle present in the track section 18, corresponding to the second predetermined state.

If the second monitoring phase 130 comprises monitoring the transmitted current intensity during the predetermined time period, the changing step 140 comprises for example changing the state of the track section 18 in function of this flag value.

Preferably, the changing step 140 is implemented at the earliest at the end time of the predetermined time period.

For example, the changing step 140 comprises changing the state of the track section to the second predetermined state, if the flag value is in the active flag value at the end time. This indicates that at least one of the present values of the transmitted current intensity, during the predetermined time period is higher than the second initial value, and indicates thus the presence of a railway vehicle in the track section 18. For example, the changing step 140 comprises changing the state of the track section to the third predetermined state, if the flag value is in the inactive flag value at the end time of the predetermined time period. This indicates that none of the present values of the transmitted current intensity, during the predetermined time period, is higher than the second initial value, and thus indicates that the decrease of the received current is due to a broken rail 22.

In particular, implementing the changing step 140 only at the end time of the predetermined time period and in function of the flag value, allows differentiating between the case according to which the decrease of the received current intensity is due to a broken rail 22 in the track section 18 and the case according to which the decrease of the received current intensity is due to shunting by a train axle, because a railway vehicle is present in the track section 18.

The inventors have found that in the case according to which the track section 18 is occupied by a railway vehicle, the transmitted current intensity varies over time along with the movement of the railway vehicle inside the track section 18. At least at one moment during the predetermined time period, the transmitted current intensity is thus detected to be higher than the second initial value, even if the track section 18 presents a large length. This allows thus to distinguish between the second and the third predetermined states.

For example, at least one of the first monitoring phase 120 and the second monitoring phase 130 is implemented in form of a monitoring loop.

For example, the first monitoring phase 120 comprises a monitoring loop comparing a plurality of consecutive present values of the received current intensity with the first initial value.

For example, the second monitoring phase 130 comprises a monitoring loop comprising monitoring of a plurality of consecutive present values of the transmitted current intensity with the second initial value. This allows monitoring the corresponding present values over a longer period of time.

The method 100 is preferably implemented several times.

For example, the method 100 comprises an implementation of the measuring step 110, of the first monitoring phase 120, of the second monitoring phase 130 and of the changing step 140 in a consecutive manner, before a repeating the steps and phases 110, 120, 130, 140.

The first monitoring phase 120 uses for example the present value of the received current intensity, as measured during the measuring step 110 at a measuring instant. In this case, the second monitoring phase 130 uses the present value of the transmitted current intensity as measured during the measuring step 110 at the same instant as said measuring instant. In other words, in particular, the first monitoring phase 120 and the second monitoring phase 130 are implemented on the basis of measurements, in form of the corresponding present values, which are obtained at the same instant.

According to above described examples of the method 100, the receiving track device is the first track device 30. According to an alternative example, the receiving track device is the second track device 32. In this case, the first track device 30 measures the transmitted current intensity at the first end 26, and the second track device 32 measures the received current intensity at the second end 28. In particular, in this case, the received current intensity, measured at the second end 28, results from the application of the second voltage by the first track device 30 at the first end 26.

The method 100 presents a large number of advantages.

In particular, the fact that the method comprises comparing a relative change value with a relative threshold value, instead of for example comparing of an absolute change value with an absolute threshold value, allows adapting the monitoring automatically to given circumstances of the current transmission in the given track section. In particular, it is not necessary to adapt the threshold value manually, as required for an absolute threshold value of the current, for example a value in ampere. Indeed, thanks to the relative threshold value, which is compared with a relative change value comprising a percentage of a variation, modifications of the current value actually received through the rails 22 of the track section, for example due to change of weather conditions or shunting conditions, and so on, are automatically taken into account. Thus, the method 100 allows determining a change of a state of the track section in a safe manner, and without erroneous interpretation of a decrease or increase of the received or transmitted current intensity.

Finally, in embodiments in which the second monitoring phase 130 comprises monitoring of the transmitted current intensity during the predetermined time period, very long track sections can be controlled thanks to the method in a reliable manner, because this monitoring over time allows distinguishing between cases of a presence of a railway vehicle in the track section and cases of broken rails 22. In particular, the inventors have found that in the case of a broken rail in the track section 18, when the track section is very long, the change of the transmitted current intensity is very small, or even undetectable. In contrast to this, even in cases of very long track sections, the presence of a railway vehicle in the track section 18 leads, at least at one moment during the travel of the railway vehicle through the track section 18, to an increased transmitted current intensity. In order to monitor such travel of the railway vehicle through the section 18 and detect this increased transmitted current intensity at one moment, the transmitted current intensity is thus, according to embodiments, monitored during the predetermined time period. This allows thus distinguishing between the cases of the second and third predetermined states, and change the state accordingly.

What is claimed is:

1. A method for determining a change of a state of a track section of a railroad, the track section comprising a first end electrically connected to a first track device, and a second end electrically connected to a second track device, the track section further comprising rails connecting the first end with the second end, the track section being associated with at least one computing unit, at least one of the first track device and the second track device being in communication with the computing unit, upon initialization of the method, the state of the track section being a first predetermined state, wherein at least one of the first track device and the second track device, called receiving track device, measures a received current intensity at a receiving end, the receiving end being the end among the first end and the second end, which is electrically connected to the receiving track device, wherein the received current intensity is equal to a first initial value upon initialization of the method, and the first track device applies a voltage to the first end and measures a transmitted current intensity transmitted by the first track device along the rails of the track section towards the second end, wherein the transmitted current intensity is equal to a second initial value upon initialization of the method, the method comprising:

first monitoring of the received current intensity, wherein the first monitoring comprises comparing at least one present value of the received current intensity measured by the receiving track device with said first initial value so as to obtain a relative change value comprising a percentage of variation of the received current intensity, wherein the first monitoring further comprises comparing the relative change value with a relative threshold value so as to obtain a comparison result;

second monitoring comprising monitoring of the transmitted current intensity so as to obtain a monitoring result, the second monitoring being implemented if the comparison result indicates a decrease of the received current intensity according to the relative change value more than the relative threshold value; and changing of the state of the track section, in function of the monitoring result, to a second predetermined state or a third predetermined state.

2. The method according to claim 1, wherein the changing of the state of the track section comprises changing the state to the second predetermined state if the monitoring result indicates an increase of the transmitted current intensity in comparison with the second initial value, and wherein said changing comprises changing the state to the third predetermined state if the monitoring result indicates a decrease of the transmitted current intensity in comparison with the second initial value.

3. The method according to claim 1, wherein the second monitoring comprises monitoring the transmitted current intensity during a predetermined time period delimited by a start time and an end time, so as to obtain the monitoring result, wherein, if during said predetermined time period, a present value of the transmitted current intensity is higher than the second initial value, the second monitoring further comprises modifying a flag value from an inactive flag value to an active flag value, wherein said changing comprises changing of the state in function of the flag value.

4. The method according to claim 3, wherein said changing of the state is implemented at the earliest at said end time.

5. The method according to claim 3, wherein said changing comprises changing the state of the track section to the second predetermined state, if the flag value is the active flag value at the end time, and wherein said changing comprises changing the state of the track section to the third predetermined state, if the flag value is the inactive flag value at the end time.

6. The method according to claim 1, wherein the first predetermined state corresponds to the track section being unoccupied, the second predetermined state corresponds to the track section being occupied by a railway vehicle, and the third predetermined state corresponds to at least one of the rails of the track section being broken.

7. The method according to claim 1, wherein at least one of the first monitoring and the second monitoring is implemented in form of a monitoring loop, wherein the monitoring loop of the first monitoring comprises comparing a plurality of consecutive present values of the received current intensity with said first initial value, and/or wherein the monitoring loop of the second monitoring comprises monitoring of a plurality of consecutive present values of the transmitted current intensity with the second initial value.

8. The method according to claim 1, wherein the relative threshold value is substantially equal to 45%.

9. A non-transitory computer-readable medium including a computer program comprising software instructions which, when executed by a computer, implement a method according to claim 1.

10. An apparatus for determining a change of a state of a track section of a railroad comprising a first end, a second end and rails connecting the first and with the second end, the apparatus comprising a first track device configured to be electrically connected to the first end of the track section, a second track device configured to be electrically connected to the second end of the track section, and at least one computing unit configured to communicate with at least one of the first track device and the second track device, wherein the apparatus is configured to present an initial condition, in which the state of the track section is defined to a first predetermined state, wherein at least one of the first track device and the second track device, called receiving track device, measures a received current intensity received at a receiving end, the receiving end being the end among the first end, which is electrically connected to the receiving track device, wherein, in the initial condition, the received current intensity is equal to a first initial value, wherein the first track device applies a voltage to the first end and measures a transmitted current intensity transmitted by the first track device along the rails of the track section towards the second end, and wherein, in the initial condition, the transmitted current intensity is equal to a second initial value, wherein the computing unit is configured for implementing:

first monitoring of the received current intensity, wherein the first monitoring comprises comparing at least one present value of the received current intensity measured by the receiving track device with said first initial value so as to obtain a relative change value comprising a percentage of variation of the received current intensity, wherein the first monitoring further comprises comparing the relative change value with a relative threshold value so as to obtain a comparison result;

second monitoring comprising monitoring of the transmitted current intensity so as to obtain a monitoring result, the second monitoring being implemented if the comparison result indicates a decrease of the received current intensity according to the relative change value more than the relative threshold value;

changing of the state of the track section, in function of the monitoring result, to a second predetermined state or a third predetermined state.

* * * * *